US005560170A

United States Patent [19]

Ganser et al.

[11] Patent Number: 5,560,170

[45] Date of Patent: Oct. 1, 1996

[54] TRIM BANDS AND TRIM BAND SYSTEM FOR CUSTOM FITTING SIDING

[75] Inventors: Dennis H. Ganser; Paul A. Vosen, both of Monona, Wis.

[73] Assignee: Ganser Company, Inc., Madison, Wis.

[21] Appl. No.: 258,423

[22] Filed: Jun. 10, 1994

[51] Int. Cl.[6] ..... E04D 1/00

[52] U.S. Cl. ..... 52/539; 52/212; 52/546; 52/521; 52/555

[58] Field of Search ..... 52/518, 537, 539, 52/542, 529, 555, 204.53, 204.54, 211, 530, 546, 587.1, 588.1, 212, 96, 204.1

[56] References Cited

U.S. PATENT DOCUMENTS

| | | | |
|---|---|---|---|
| 705,207 | 7/1902 | Charlebois | 52/530 X |
| 2,245,785 | 6/1941 | Jentzer . | |
| 2,309,453 | 1/1943 | Hasenburger . | |
| 3,139,703 | 7/1964 | Hilt . | |
| 3,304,676 | 2/1967 | Sallie et al. | 52/555 X |
| 3,969,866 | 7/1976 | Kyne | 52/539 X |
| 4,015,391 | 4/1977 | Epstein et al. . | |
| 4,196,948 | 4/1980 | Gavel et al. | 52/539 X |
| 4,292,781 | 10/1981 | Chalmers et al. . | |
| 4,418,505 | 12/1983 | Thompson . | |
| 4,450,665 | 5/1984 | Katz | 52/546 X |
| 4,593,512 | 6/1986 | Funaki | 52/539 X |
| 4,603,068 | 7/1986 | Hunter | 52/539 X |
| 4,947,609 | 8/1990 | Champagne . | |
| 5,224,318 | 7/1993 | Kemerer . | |
| 5,347,784 | 9/1994 | Crick et al. | 52/546 X |

FOREIGN PATENT DOCUMENTS

| | | | |
|---|---|---|---|
| 2808173 | 8/1979 | Germany | 52/539 |

OTHER PUBLICATIONS

TAPCO™ Operations Manual, Apr. 1989.

*Primary Examiner*—Carl D. Friedman
*Assistant Examiner*—Winnie Yip
*Attorney, Agent, or Firm*—DeWitt Ross & Stevens SC

[57] ABSTRACT

Trim bands and a trim band system for custom fitting siding is presented. The trim bands include a base band, a frieze band, a mid band, and an inside corner band which function to retain the rough edges of siding panels without exposing channels thereby providing a custom fit and enhanced aesthetic appearance. The trim bands are one piece continuous members which comprise varying numbers of portions which depend on the structural area of the building for which the trim bands are designed. The trim band system includes securing a plurality of trim bands to the exterior surface of a building followed by the placement and attachment of siding panels in conjunction with the trim bands to conceal all exposed edges of the siding panels without exposing channels or troughs formed within the trim bands.

18 Claims, 5 Drawing Sheets

TRIM BANDS AND TRIM BAND SYSTEM FOR CUSTOM FITTING SIDING

FIELD OF THE INVENTION

The present invention relates generally to the field of exterior building surfaces. More particularly, the present invention relates to a system for custom fitting siding panels which uses individual trim bands to conceal siding edges or terminations while still allowing the system and siding panels to float on the house.

DESCRIPTION OF THE PRIOR ART

The use of aluminum, vinyl, and steel siding panels on the exterior surface of buildings has become more commonplace due to the increased economy of such panels resulting from increased durability and decreased maintenance. Several starter strips, support strips, and cover strips which are designed for use with siding panels are known in the prior art. For example, U.S. Pat. No. 3,139,703 to Hilt discloses a sheet metal cover for window and door frames to be used in connection with the installation of siding. The cover comprises a metal band which is bent to form a channel for holding and concealing the edges of siding which surround the perimeter of a door or window frame on a house. Although the Hilt cover piece may be used in the present inventive system, the inventive system is an improvement over the Hilt cover piece in that it provides for a complete custom trim system for the edges of all existing siding panels which are attached to a house.

U.S. Pat. No. 4,292,781 to Chalmers et al. describes a siding system with support strips that are nailed to the house which function to support the siding panels. The support strips include both retainer strips and starter strips. The retainer strip comprises a horizontally extending mounting leg and a horizontally extending hook which depends from the leg and forms an inwardly and upwardly opening channel for engaging and holding edge portions of siding panels. The starter strip comprises a horizontally extending longitudinally upwardly opening channel flange that extends from a horizontally extending longitudinal upwardly projecting leg. A plurality of nail holes are spaced along an upper length of the retainer strip hook and the starter strip leg for attaching the strips to a building.

Another piece designed for use with mounting siding panels is disclosed in U.S. Pat. No. 4,947,609 to Champagne. The Champagne patent describes a clip for installing the top out panel of vinyl siding. The clip comprises a continuous strip of metal having seven contiguous portions which define two vertically spaced downwardly opening gripping channels. The gripping channels engage the overlying top edge of a bottom siding panel and the bottom edge of a top out siding panel, respectively.

The Port-O-Bender Operations Manual produced by Tapco Products Co., Inc. discloses a machine for bending sheet metal into desired trim shapes and designs. Several common trim shapes are disclosed which can be custom made on the job site with built in "J" channels or hemmed edges.

U.S. Pat. No. 2,309,453 to Hasenburger et al. discloses a prefabricated building wall which includes a bottom support sill and panel locking clips that ride in vertical frames. The bottom support sill includes longitudinally extending sections and lower strip portions which extend from the sections. The lower strip portion positioned on the outer side of the sill comprises an upwardly extending rib which functions as an attachment means for a siding panel.

Strip configurations for starting and retaining roof and wall tiles are also disclosed in the prior art. U.S. Pat. No. 4,418,505 to Thompson describes a starter strip for laying tile roofs. The starter strip includes a base portion which is supported by the roof structure, a cover portion which extends downwardly from a front edge of the base portion to overlie an exposed portion of the roof, and a riser portion which extends upwardly from the front end of the base portion.

U.S. Pat. No. 2,245,785 to Jentzer et al. discloses a wall covering system which includes metal stamped wall tiles and a series of retaining strips to secure the tiles in place. The tile retaining strips are bent from sheet metal and constitute a base plate, a web extending from the base plate, and oppositely disposed rails which extend from the web and hook into the tiles.

Another U.S. patent to Epstein et al., U.S. Pat. No. 4,015,391, discloses a simulated cedar shake construction which includes bottom starter strips, top or gable strips, corners, and ridge caps. The bottom starter strip contains a nailing strip and a U-shaped channel. The bottom edges of the lower most shakes are fitted into the U-shaped channel. The gable strip comprises a U-shaped channel wherein one leg of the "U" contains an inward bend directed toward the other leg of the "U", and a nailing tab which extends from the bent leg.

In summary, there are a number of strip members which are designed to start, retain, support, and cover the siding panels which are used in siding a building or home. However, no complete system is disclosed for custom fitting siding panels such that the siding panel edges on an entire surface of a home or building structure are internally concealed without the use of "J" type channels and underlying support structures. Furthermore, no trim components are disclosed without standard "J" type channels which function as base bands, frieze bands, mid bands, or inside corners on a structure.

Accordingly, there is a need for an improved system and associated trim bands which function to accentuate the length, height, bulk, weight, and overall aesthetic effect of a building by providing a channel free siding system. There is also a need for an improved trim system containing trim bands for siding panels which is capable of being custom fit to any type of building.

SUMMARY OF THE INVENTION

It is a principal object of the present invention to provide trim bands and a trim band system for custom fitting siding panels on a building or home.

It is a further object of the present invention to provide trim bands which simulate the length, height, bulk and weight of painted trim boards, and a trim band system for custom fitting siding which enhances the overall aesthetic effect of a building or home.

It is a still further object of the present invention to provide a system for custom fitting siding that includes trim bands having furrows which internally conceal the edges of the siding thereby eliminating the cluttered look of using standard "J" type channels.

It is yet a further object of the present invention to provide trim bands and a trim band system for custom fitting siding which accommodates the moving or shifting of a structure over time by floating the trim band system and siding on the surface of the structure.

It is still a further object of the present invention to provide trim bands and a trim band system which do not require an underlying support structure.

The inventive trim bands contained in the trim band system of the present invention include a base band, a frieze band, a mid band, and an inside corner band. The base band is a generally a one-piece member having five continuous horizontally elongated planar portions which include a first vertical portion, a first horizontal portion extending from the first vertical portion to form a ledge, a second vertical portion extending downwardly from the ledge, a second horizontal portion extending from the back of the second vertical portion, and a third vertical portion extending upwardly from the second horizontal portion.

The frieze band of the present invention is generally a one-piece member having six continuous horizontally elongated planar portions which include a first vertical portion, a first horizontal portion extending outwardly from the front surface of the first vertical portion, a second vertical portion extending downwardly from the first horizontal portion, a third vertical portion extending upwardly from and back against the second vertical planar portion, a second horizontal portion extending back and outwardly from the third vertical portion, and a fourth vertical portion extending downwardly from the second horizontal portion.

The mid band of the present invention generally defines a one-piece member having seven continuous horizontally elongated planar portions including a first vertical portion, a first horizontal portion extending outwardly from the front surface of the first vertical portion, a second vertical portion extending upwardly from the first horizontal portion, a third vertical portion extending downwardly from and back against the front surface of the second vertical portion, a fourth vertical portion extending upwardly from and back against the back surface of the third vertical portion, a second horizontal portion extending outwardly from the back surface of the fourth vertical portion, and a fifth vertical portion extending downwardly from the second horizontal portion.

The inside corner band of the present invention is generally a one-piece member having eight continuous vertically elongated vertical planar portions including a first portion, a second portion extending outwardly at a right angle from the front surface of the first portion, a third portion extending outwardly at a right angle from the front surface of the second portion, a fourth portion extending back against and adjacent to the front surface of the third portion, a fifth portion extending outwardly at a right angle from the front surface of the fourth portion, a sixth portion extending back against and adjacent to the back surface of the fifth portion, a seventh portion extending outwardly at a right angle from the back surface of the sixth portion, and an eighth portion extending outwardly at a right angle from the front surface of the seventh portion.

The trim band system of the present invention for custom fitting siding panels includes the steps of fastening a plurality of trim bands to the exterior surface of a building and securing a plurality of siding panels to the exterior building surface so that all of the exposed edges of the siding panels are concealed within the trim bands.

The objects and advantages of the invention will appear more fully from the following more detailed description of the preferred embodiments of the invention made in conjunction with the accompanying drawings.

DETAILED DESCRIPTION OF THE INVENTION

The present invention provides unique trim bands and a trim band system for custom fitting siding panels to the exterior surface of a building to produce what appears to be a channelless siding system. Referring now to the figures, where numerals represent various elements of the present invention, the unique trim bands of the present invention are shown in FIGS. 1–8.

Figure 1:
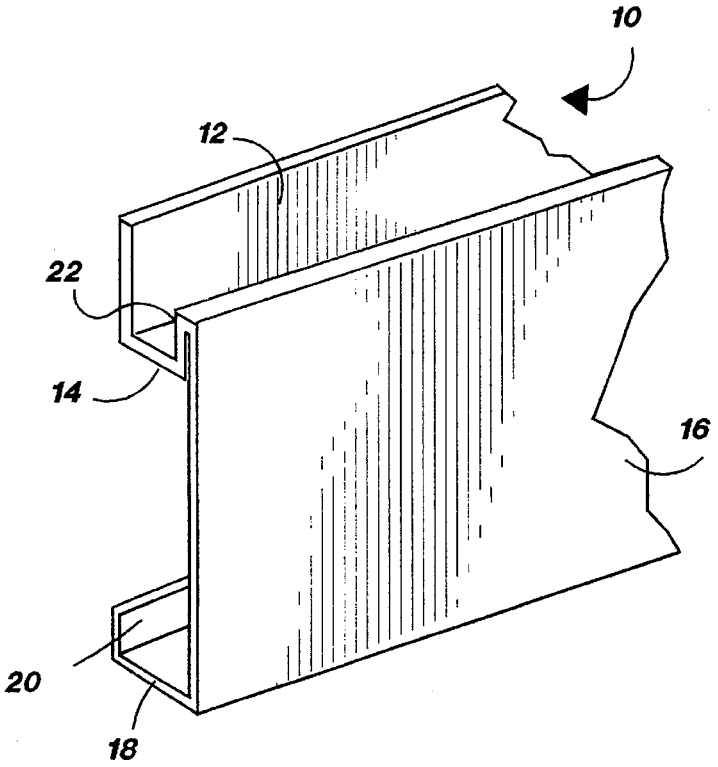
FIG. 1 is a perspective view of the base band which comprises one of the trim bands of the present invention.

FIG. 1 illustrates a perspective view of the base band 10 of the present invention. The base band 10 generally comprises a one-piece member having at least five continuous portions which include a first horizontally elongated vertical planar portion 12, a first horizontally elongated horizontal planar portion 14, a second horizontally elongated vertical planar portion 16, a second horizontally elongated horizontal planar portion 18, and a third horizontally elongated vertical planar portion 20. A horizontally elongated lip member 22 may also be provided between the first horizontal portion 14 and the second vertical portion 16.

Figure 2:
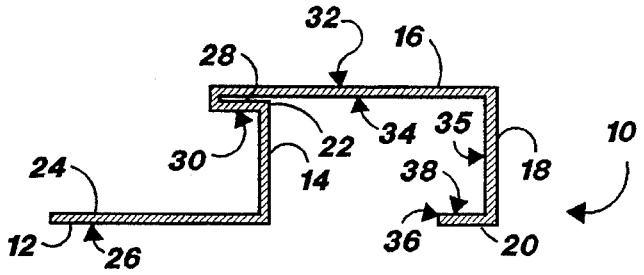
FIG. 2 is a side elevational view of the base band of the present invention.

The relationship of the continuous portions can be seen more clearly in FIG. 2 which depicts a side elevational view of the base band 10. The first vertical portion 12 comprises a first front surface 24 and a second back surface 26. The first horizontal portion 14 extends outwardly from the first front surface 24 of the first vertical portion 12 to form a ledge. The ledge may further comprise the lip member 22 which constitutes another continuous horizontally extending vertical planar member having a first front surface 28 and a second back surface 30.

The second vertical portion 16 also comprises a first front surface 32 and a second back surface 34. The second vertical portion 16 extends from the lip member 22 such that the second back surface 34 of the second vertical portion 16 is folded back against and lies adjacent to the first front surface 28 of the lip member 22. If no lip member 22 is present, then the second vertical portion 16 extends downwardly from the first horizontal portion 14.

The second horizontal portion 18 extends from the second back surface 34 of the second vertical portion 16 while the third vertical portion 20 extends upwardly from the second horizontal portion 18 to form a channel 35. The third vertical portion 20 comprises a first front surface 36 and a second back surface 38.

Figure 2A:
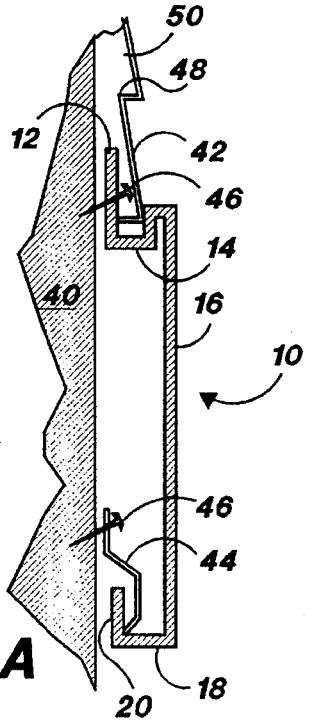
FIG. 2A is a side elevational view showing the attachment of the base band to an external building surface and the placement of the siding panels in conjunction with the base band.

The base band 10 is shown mounted to an exterior surface of a building 40 with a lower most siding panel 42 in FIG. 2A. A starter clip 44 is attached to the exterior building surface 48 by nails 46, screws, or other similar attachment means. The base band 10 is secured to the exterior building surface 48 by attaching the first vertical portion 12 of the base band 10 to the exterior building surface 40 by nails 46 or other similar attachment means, and then hooking the channel 35 formed at the bottom of the base band 10 around the starter clip 44.

Once the base band 10 is secured to the exterior building surface 40, the lower most siding panel 42 is positioned over the first vertical portion 12 of the base band 10 just above the first horizontal portion 14 of the base band 10. The lower most siding panel is then attached to the exterior building surface 48 near its top end 48 so that the next siding panel 49 can be positioned over the attachment point of the lower most siding panel 42.

Figure 3:
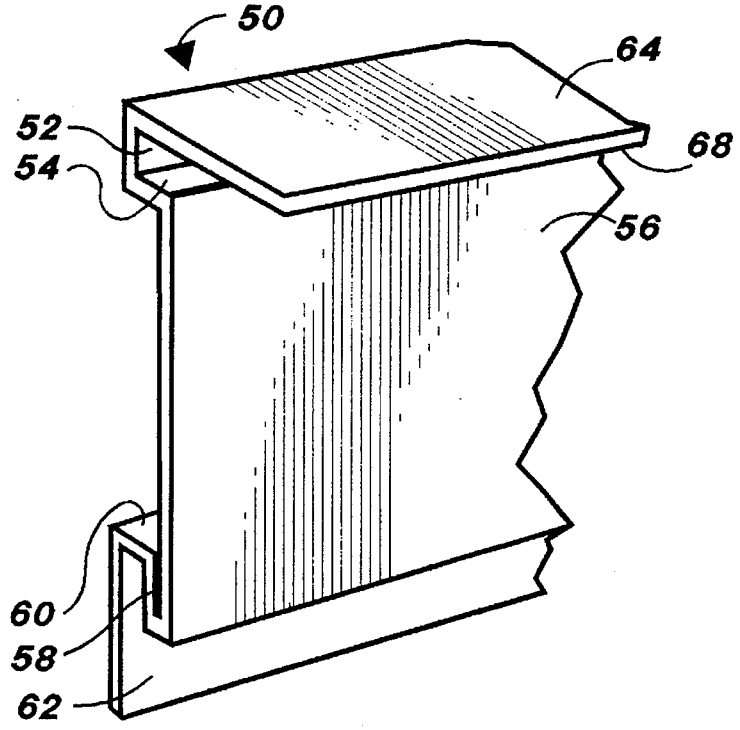
FIG. 3 is a perspective view of the frieze band which comprises one of the trim bands of the present invention.

Turning now to FIG. 3, there is shown a perspective view of the frieze band 50 of the present invention. The frieze band 50 generally comprises a one piece member having at least six horizontally elongated continuous planar portions which include a first vertical portion 52, a first horizontal portion 54, a second vertical portion 56, a third vertical portion 58, a second horizontal portion 60, and a fourth vertical portion 62. The frieze band 50 may also include a horizontally elongated third horizontal planar portion 64 having a first upper surface 66 and a second lower surface 68 where the third horizontal member 64 extends from the first vertical portion 52 of the frieze band 50.

Figure 4:
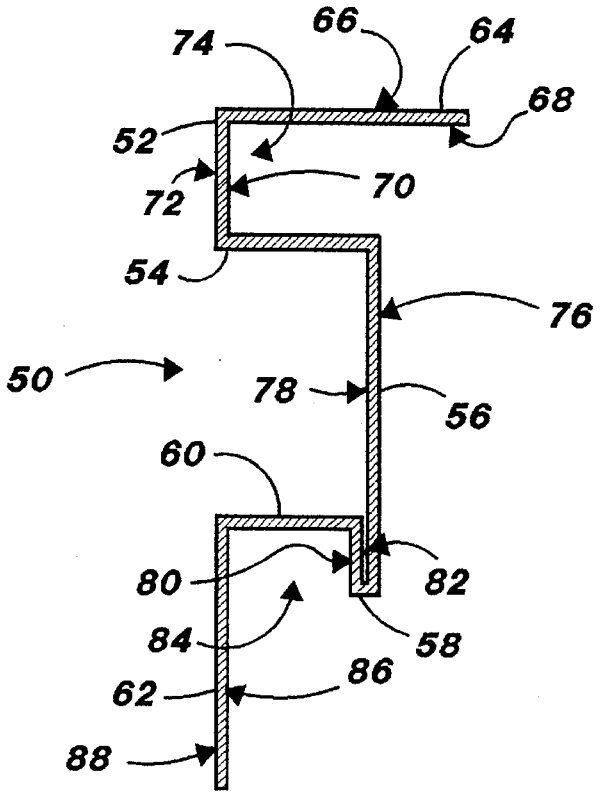
FIG. 4 is a side elevational view of the frieze band of the present invention.

The contiguous connection of the various portions comprising the frieze band 50 is illustrated in the side elevational view of the frieze band 50 shown in FIG. 4. The first vertical portion 52 extends from the second lower surface 68 of the optional horizontally elongated third horizontal planar portion 64. The first vertical portion 52 comprises a first front surface 70 and a second back surface 72. The first horizontal portion 54 extends from the first front surface 70 of the first vertical portion 52 to form a channel 74 for receiving a soffit.

The second vertical portion 56 extends downwardly from the first horizontal portion 54 and comprises a first front surface 76 and a second back surface 78. The third vertical portion 58 also has a first front surface 80 and a second back surface 82. The second back surface 82 of the third vertical portion 58 is folded back against and lies adjacent to the second back surface 78 of the second vertical portion 56.

The second horizontal portion 60 extends from the first front surface 80 of the third vertical portion 58 and the fourth vertical portion 62 extends downwardly from the second horizontal portion 60 thereby forming a second channel 84. The fourth vertical portion 62 comprises a first front surface 86 and a second back surface 88. During actual use, a top portion of an upper most siding panel is positioned within the second channel 84 and adjacent to the first front surface 86 of the fourth vertical portion 62 of the frieze band 50.

Figure 5:
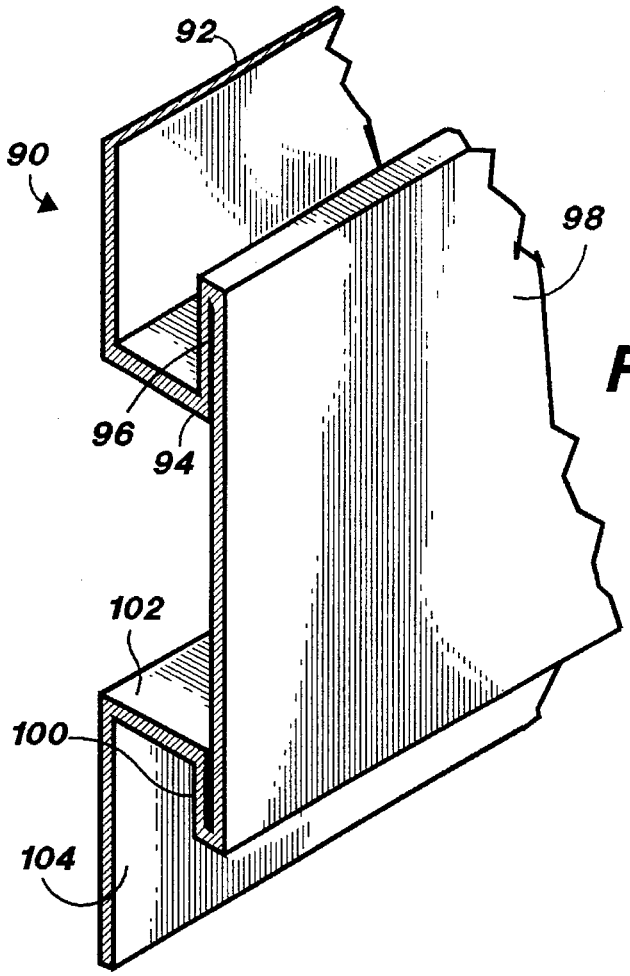
FIG. 5 is a perspective view of the mid band which comprises one of the trim bands of the present invention.

A perspective view of the mid band 90 of the present invention is shown in FIG. 5. The mid band 90 generally comprises a continuous one piece member having at least seven horizontally elongated contiguous planar portions which include a first vertical portion 92, a first horizontal portion 94, a second vertical portion 96, a third vertical portion 98, a fourth vertical portion 100, a second horizontal portion 102, and a fifth vertical portion 104.

Figure 6:
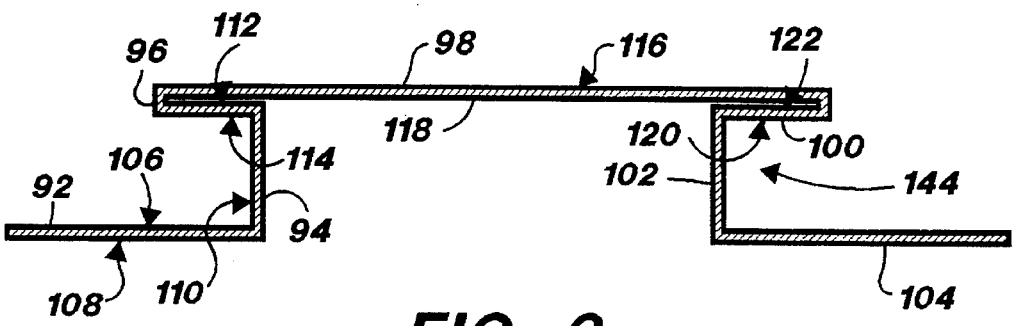
FIG. 6 is a side elevational view of the mid band of the present invention.
Figure 8:
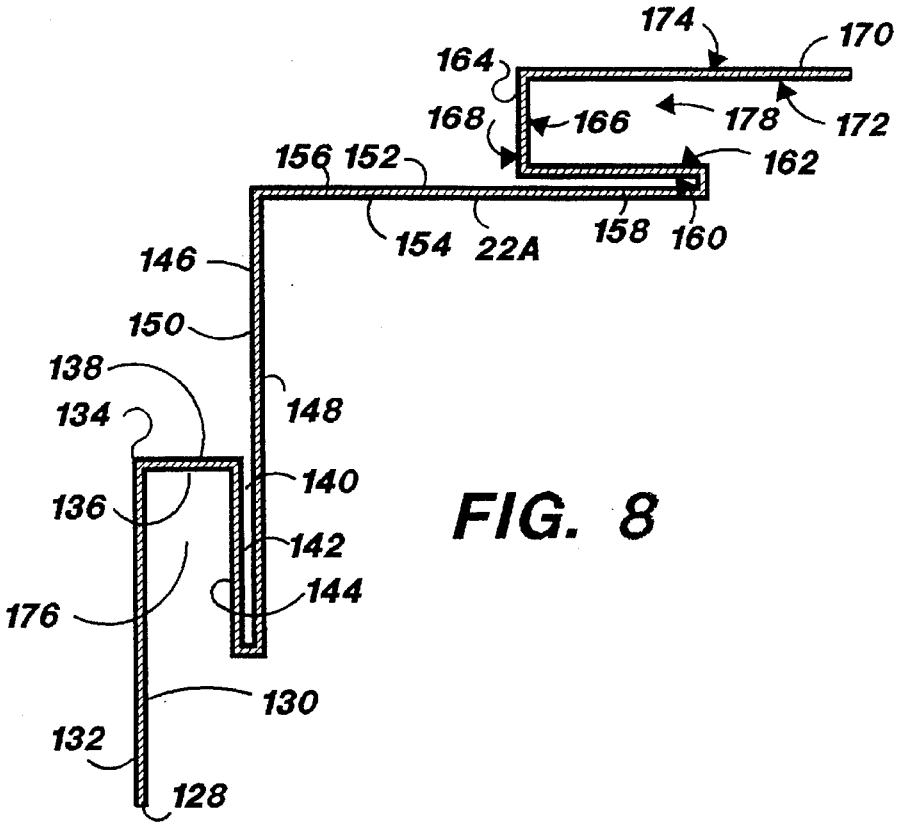
FIG. 8 is a top elevational view of the inside corner band of the present invention.

FIG. 6 illustrates the contiguous connection of the portions which comprise the continuous one piece mid band 90. The first vertical portion comprises a first front surface 106 and a second back surface 108. The first horizontal portion 94 extends outwardly from the first front surface 106 of the first vertical portion 92 and the second vertical portion 96 extends upwardly from the first horizontal portion 94 to form a first channel 110.

The second vertical portion 96 comprises a first front surface 112 and a second back surface 114 and the third vertical portion 98 comprises a first front surface 116 and a second back surface 118. The first front surface 112 of the second vertical portion 96 is folded back against and adjacent to the second back surface 118 of the third vertical portion 98. The fourth vertical portion 100 also comprises a first front surface 120 and a second back surface 122 with the second back surface 122 being folded against and positioned adjacent to the second back surface 118 of the third vertical portion 98.

The second horizontal portion 102 extends outwardly from the first front surface 120 of the fourth vertical portion 100 and the fifth vertical portion 104 extends downwardly from the fourth vertical portion 100 to form a second channel 124. During use, the mid band 90 is placed on a mid portion of the exterior surface of a building and siding panels are positioned within the first and second channels 110, 124 such that a bottom portion of a siding panel is placed within the first channel 110 and a top portion of a siding panel is placed in the second channel 124. Once the siding panels are positioned and secured, the first and second channels 110, 124 are not visible.

Figure 7:
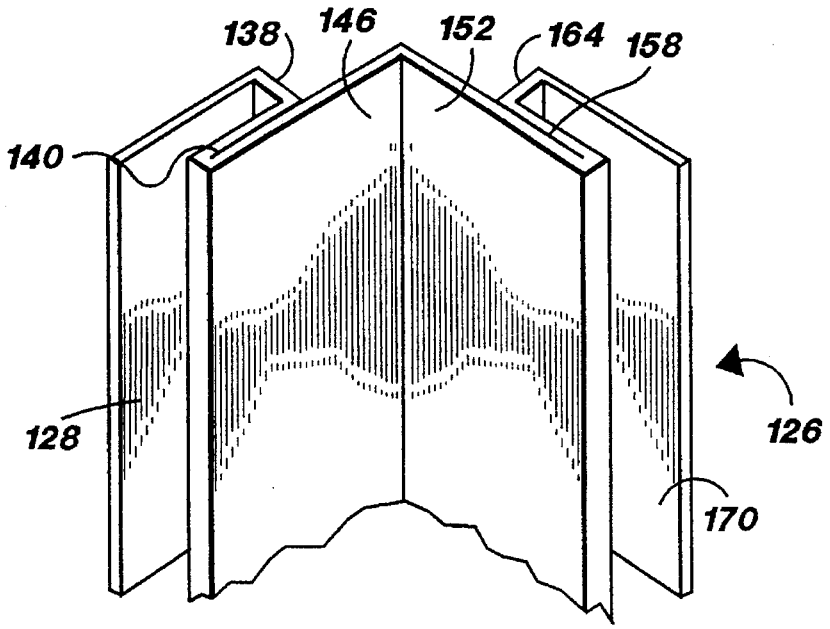
FIG. 7 is a perspective view of the inside corner band which comprises one of the trim bands of the present invention.

FIG. 7 shows a perspective view of the inside corner band 126 of the present invention. The inside corner band 126 generally comprises a one piece member having at least eight vertically elongated continuous planar portions which include a first portion 128 having a first front surface 130 and a second back surface 132, a second portion 134 having a first front surface 136 and a second back surface 138, a third portion 140 having a first front surface 142 and a second back surface 144, a fourth portion 146 having a first front surface 148 and a second back surface 150, a fifth portion 152 having a first front surface 154 and a second back surface 156, a sixth portion 158 having a first front surface 160 and a second back surface 162, a seventh portion 164 having a first front surface 166 and a second back surface 168, and an eighth portion 170 having a first front surface 172 and a second back surface 174.

As illustrated in FIG. 5, which shows a top elevational view of the inside corner band 126, the second portion 134 extends from the first front surface 130 of the first portion 130 at a right angle to the first portion 130. The third portion 140 extends at a right angle form the first front surface 136 of the second portion 134 to form a first channel 176 for retaining the side edges of siding panels (See FIG. 9).

The second back surface 150 of the fourth portion 146 is bent back against and positioned adjacent to the first front surface 142 of the third portion 140. The fifth portion 152 extends outwardly at a right angle from the first front surface 148 of the fourth portion 146, and the first front surface 160 of the sixth portion 158 is bent back against and positioned adjacent to the second back surface 156 of the fifth portion 152.

The seventh portion 164 extends outwardly at a right angle from the second back surface 162 of the sixth portion 158 and the eighth portion 170 extends outwardly at a right angle to the first front surface 166 of the seventh portion 164 to form a second channel 178. The second channel 178 functions to retain the side edges of siding panels in the same way as the first channel 176.

Figure 9:
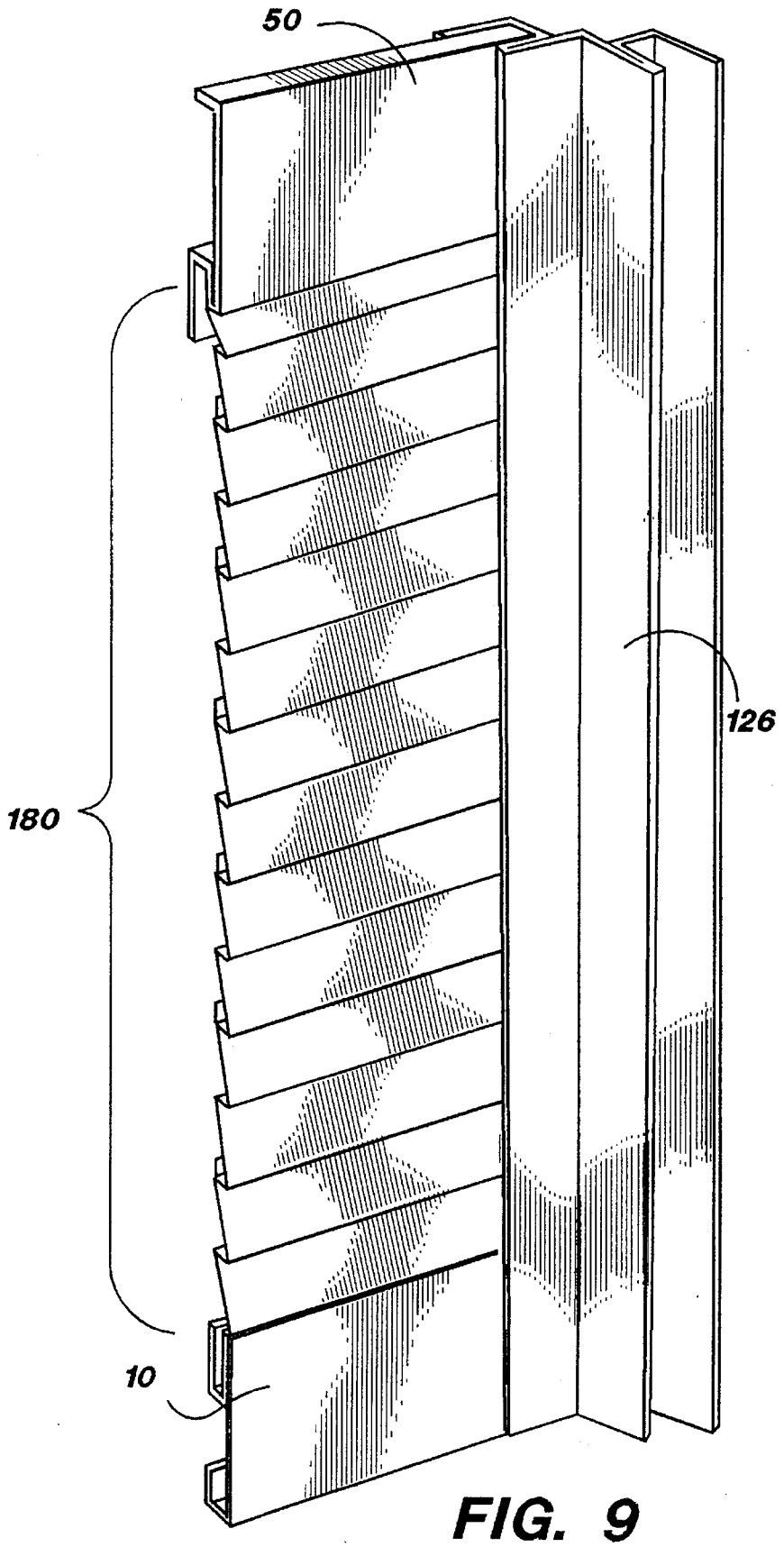
FIG. 9 is a perspective view of part of the trim band system of the present invention showing the fitting of siding panels within the frieze band, base band, and inside corner band of the present invention.

FIG. 9 shows a perspective view of a portion of the trim band system in use. As previously described, siding panels 180 are positioned within the base band 10, frieze band 50, and inside corner band 126 to provide a trim and siding system which appear to be channelless.

The trim bands of the present invention are preferably comprised of bent sheet metal, extruded plastic, or extruded vinyl.

While preferred embodiments of the invention have been shown and described, it will be apparent to those skilled in this art that various modifications may be made in these embodiments without departing from the spirit of the present invention. Therefore, all suitable modifications and equivalents fall within the scope of the invention.

What is claimed is:

1. A base band (10) for custom fitting lower most siding panels on a building wherein the base band (10) has five horizontally elongated planar contiguous portions comprising:

(a) a first vertical portion (12) having a first from surface (24) and an opposing second back surface (26);

(b) a first horizontal portion (14) extending from the first from surface (24) of the first vertical portion (12), thereby forming a ledge;

(c) a horizontally elongated planar lip portion (22) extending upwardly from the first horizontal portion (14), thereby forming an upwardly-oriented second channel between the lip portion (22) and the first vertical portion (12);

(d) a second vertical portion (16), having a first front surface (32) and an opposing second back surface (34), wherein the second vertical portion (16) extends downwardly from the lip portion (22);

(e) a second horizontal portion (18) extending from the second back surface (34) of a lower most point of the second vertical portion (16); and (f) a third vertical portion (20) extending upwardly from the second horizontal portion (18) and resting in substantially the same plane as the first vertical portion (12), thereby forming a first channel between the second vertical portion (16) and the third vertical portion (20).

2. The base band of claim 1 wherein the base band is comprised of bent sheet metal.

3. The base band of claim 1 wherein the base band is comprised from at least one of extruded plastic and extruded vinyl.

4. The base band (10) of claim 1 wherein the first vertical portion (12) and third vertical portion (20) rest in a plane substantially parallel to the second vertical portion (16).

5. A frieze band (50) for custom fitting upper most siding panels on a building wherein the frieze band (50) has six horizontally elongated planar contiguous portions comprising:

(a) a first vertical portion (52) having a first front surface (70) and a second back surface (72);

(b) a first horizontal portion (54) extending outwardly from the first front surface (70) of the first vertical portion (50);

(c) a second vertical portion (56), having a first front surface (76) and a second back surface (78), extending downwardly from the first horizontal portion (54);

(d) a third vertical portion (58), having a first front surface (80) and a second back surface (82), extending upwardly from the second vertical portion (56) such that the second back surface (82) of the third vertical portion (58) lies adjacent to the second back surface (78) of the second vertical portion (56);

(e) a second horizontal portion (60) extending from the first front surface (80) of the third vertical portion (58);

(f) a fourth vertical portion (62) extending downwardly from the second horizontal portion (60) and resting in substantially the same plane as the first vertical portion (52), thereby forming a downwardly-directed first channel (84) between the third vertical portion (58) and fourth vertical portion (62); and (g) a third horizontal portion (64) which extends outwardly from the first front surface (70) of the first vertical portion (52), thereby defining a soffit channel between the first horizontal portion (54) and the third horizontal portion (64).

6. The frieze band of claim 5 wherein the frieze band is comprised of bent sheet metal.

7. The frieze band of claim 5 wherein the frieze band is comprised from at least one of extruded plastic and extruded vinyl.

8. The frieze band (50) of claim 5 wherein the first vertical portion (52) and fourth vertical portion (62) rest in a plane substantially parallel to the second vertical portion (56).

9. A method of custom fitting siding panels on a building comprising the steps of:

(a) providing a trim band system including a plurality of trim bands, the trim bands including:

(1) a base band (10) including six horizontally elongated planar portions comprising:

(i) a first vertical portion (12) having a front surface (24) and an opposing back surface (26) bounded by an upper edge and an opposing lower edge;

(ii) a first horizontal portion (14) extending generally perpendicularly from the front surface (24) of the first vertical portion (12) at the lower edge of the first vertical portion (12), the first horizontal portion (14) having a front surface and an opposing back surface bounded by an outer edge and an opposing inner edge wherein the inner edge is coincident with the lower edge of the first vertical portion (12);

(iii) a lip (22) extending generally perpendicularly from the front surface of the first horizontal portion (14) at the outer edge of the first horizontal portion (14), thereby forming a base band channel between the lip (22) and the first vertical portion (12), (iv) a second vertical portion (16) extending downwardly from the lip and terminating in a lower edge, the second vertical portion (16) having a front surface (32) and an opposing back surface (34);

(v) a second horizontal portion (18) extending from the back surface (34) of the second vertical portion (16) at the lower edge of the second vertical portion (16), the second horizontal portion (18) having a front surface and an opposing back surface bounded by an inner edge and an opposing outer edge wherein the outer edge is coincident with the lower edge of the second vertical portion (16);

(vi) a third vertical portion (20) extending upwardly from the back surface of the second horizontal portion (18) at the inner edge of the second horizontal portion (18), wherein the third vertical portion (20) is generally coplanar with the first vertical portion (12);

(2) a frieze band (50) including five horizontally elongated planar portions comprising;

(i) a first vertical portion (52) having a front surface (70) and an opposing back surface (72) bounded by an upper edge and an opposing lower edge;

(ii) a first horizontal portion (54) extending generally perpendicularly from the front surface (70) of the first vertical portion (52) at the lower edge of the first vertical portion (52), the first horizontal portion (54) having a from surface and an opposing back surface bounded by an outer edge and an opposing inner edge wherein the inner edge is coincident with the lower edge of the first vertical portion (52);

(iii) a second vertical portion (56) extending downwardly from the back surface of the first horizontal portion (54) at the outer edge of the first horizontal portion (54), the second vertical portion (56) having a front surface (76) and an opposing back surface (78) bounded by a lower edge and an opposing upper edge wherein the upper edge is coincident with the outer edge of the first horizontal portion (54);

(iv) a second horizontal portion (60) having a front surface and an opposing back surface bounded by an inner edge and an opposing outer edge, wherein the outer edge is located adjacent the back surface (78) of the second vertical portion (56) and extends generally perpendicularly from the back surface (78) of the second vertical portion (56);

(v) a fourth vertical portion (62) extending generally perpendicularly from the front surface of the second horizontal portion (60) at the inner edge of the second horizontal portion (60), thereby forming a frieze band channel (84) between the second vertical portion (56) and fourth vertical portion (62), and wherein the fourth vertical portion (62) is generally coplanar with the first vertical portion (52);

(3) a midband (90) including five horizontally elongated planar portions comprising:

(i) a first vertical portion (92) having a front surface (106) and an opposing back surface (108) bounded by an upper edge and an opposing lower edge;

(ii) a first horizontal portion (94) extending generally perpendicularly from the front surface (106) of the first vertical portion (92) at the lower edge of the first vertical portion (92), the first horizontal portion (94) having a front surface and an opposing back surface bounded by an outer edge and an opposing inner edge wherein the inner edge is coincident with the lower edge of the first vertical portion (92);

(iii) a third vertical portion (98) having a front surface (116) and an opposing back surface (118) bounded by an upper edge and an opposing lower edge, wherein the outer edge of the first horizontal portion (94) rests spaced from the upper edge of the third vertical portion (98) adjacent the back surface (118) of the third vertical portion (98), and further wherein the third vertical portion (98) and first vertical portion (92) define a first midband channel (110);

(iv) a second horizontal portion (102) extending generally perpendicularly from the back surface (118) of the third vertical portion (98) and terminating at an inner edge, the second horizontal portion having a front surface and an opposing back surface;

(v) a fifth vertical portion (104) extending generally perpendicularly from the front surface of the second horizontal portion (102) at the inner edge of the second horizontal portion (102), thereby forming a second midband channel (124) between the third vertical portion (98) and fifth vertical portion (104), and wherein the fifth vertical portion (104) is generally coplanar with the first vertical portion (92);

(4) a corner band (126) including six vertically elongated planar portions comprising:

(i) a first portion (128) having a front surface (130) and an opposing back surface (132) bounded by an outer edge and an opposing inner edge;

(ii) a second portion (134) extending generally perpendicularly from the front surface (130) of the first portion (128) at the inner edge of the first portion (128), the second portion (134) having a front surface (136) and an opposing back surface (138) bounded by an inner edge and an outer edge coincident with the inner edge of the first portion (128);

(iii) a fourth portion (146) having a from surface (148) and an opposing back surface (150) bounded by an inner edge and an opposing outer edge, wherein the inner edge of the second portion (134) rests spaced from the outer edge of the fourth portion (146) adjacent the back surface (150) of the fourth portion (146), and further wherein the fourth portion (146) is generally perpendicular to the second portion (134), thereby defining a first corner band channel (176) between the first portion (128) and fourth portion (146);

(iv) a fifth portion (152) extending from the from surface (148) of the fourth portion (146) at the inner edge of the fourth portion (146), the fifth portion (152) having a front surface (154) and an opposing back surface (156) bounded by an inner edge and an opposing outer edge, wherein the inner edge of the fifth portion (152) is coincident with the inner edge of the fourth portion (146);

(v) a seventh portion (164) having a front surface (166) and a back surface (168) bounded by an outer edge and an opposing inner edge, wherein the inner edge rests spaced from the outer edge of the fifth portion (152) adjacent the back surface (156) of the fifth portion (152), and further wherein the seventh portion (164) is generally perpendicular to the fifth portion (152);

(vi) an eighth portion (170) extending generally perpendicularly from the front surface (166) of the seventh portion (164) at the outer edge of the seventh portion (164), thereby defining a second corner band channel (178) between the eighth portion (170) and the fifth portion (152);

(b) securing a plurality of elongated siding panels to a building's exterior surface, wherein each siding panel has an elongated top, an elongated bottom, and two ends, and further wherein the building's exterior surface is bounded on at least one side by a corner; and (c) securing the first vertical portion (12) of the base band (10) to a lower point on the building's exterior surface so that the bottom of at least one siding panel is fit within the base band channel;

(d) securing the fourth vertical portion (62) of the frieze band (50) to an upper point on the building's exterior surface so that the top of at least one trim band is fit within the frieze band channel (84);

(e) securing the first vertical portion (92) and fifth vertical portion (104) of the midband (90) to points on the building's exterior surface between the lower and upper points so that the bottom of at least one siding band is fit within the first midband channel (110) and the top of at least one siding band is fit within the second midband channel (124); and (f) securing the first portion (128) and the eighth portion (170) of the corner band (126) to the corner so that the end of at least one siding band is fit into at least one of the first corner band channel (176) and second corner band channel (178).

10. A trim band kit for custom fitting siding panels on a building, the trim band kit comprising in combination:

a. a base band (10) including six horizontally elongated planar portions comprising:

(1) a first vertical portion (12) having a front surface (24) and an opposing back surface (26) bounded by an upper edge and an opposing lower edge;

(2) a first horizontal portion (14) extending generally perpendicularly from the front surface (24) of the first vertical portion (12) at the lower edge of the first vertical portion (12), the first horizontal portion (14) having a front surface and an opposing back surface bounded by an outer edge and an opposing inner edge wherein the inner edge is coincident with the lower edge of the first vertical portion (12);

(3) a lip (22) extending generally perpendicularly from the front surface of the first horizontal portion (14) at the outer edge of the first horizontal portion (14), thereby forming a base band channel between the lip (22) and the first vertical portion (12), (4) a second vertical portion (16) extending downwardly from the lip and terminating in a lower edge, the second vertical portion (16) having a front surface (32) and an opposing back surface (34);

(5) a second horizontal portion (18) extending from the back surface (34) of the second vertical portion (16) at the lower edge of the second vertical portion (16), the second horizontal portion (18) having a front surface and an opposing back surface bounded by an inner edge and an opposing outer edge wherein the outer edge is coincident with the lower edge of the second vertical portion (16);

(6) a third vertical portion (20) extending upwardly from the back surface of the second horizontal portion (18) at the inner edge of the second horizontal portion (18), wherein the third vertical portion (20) is generally coplanar with the first vertical portion (12);

b. a frieze band (50) including five horizontally elongated planar portions comprising:

(1) a first vertical portion (52) having a front surface (70) and an opposing back surface (72) bounded by an upper edge and an opposing lower edge;

(2) a first horizontal portion (54) extending generally perpendicularly from the front surface (70) of the first vertical portion (52) at the lower edge of the first vertical portion (52), the first horizontal portion (54) having a front surface and an opposing back surface bounded by an outer edge and an opposing inner edge wherein the inner edge is coincident with the lower edge of the first vertical portion (52);

(3) a second vertical portion (56) extending downwardly from the back surface of the first horizontal portion (54) at the outer edge of the first horizontal portion (54), the second vertical portion (56) having a front surface (76) and an opposing back surface (78) bounded by a lower edge and an opposing upper edge wherein the upper edge is coincident with the outer edge of the first horizontal portion (54);

(4) a second horizontal portion (60) having a front surface and an opposing back surface bounded by an inner edge and an opposing outer edge, wherein the outer edge is located adjacent the back surface (78) of the second vertical portion (56) and extends generally perpendicularly from the back surface (78) of the second vertical portion (56);

(5) a fourth vertical portion (62) extending generally perpendicularly from the front surface of the second horizontal portion (60) at the inner edge of the second horizontal portion (60), thereby forming a frieze band channel (84) between the second vertical portion (56) and fourth vertical portion (62), and wherein the fourth vertical portion (62) is generally coplanar with the first vertical portion (52);

c. a midband (90) including five horizontally elongated planar portions comprising:

(1) a first vertical portion (92) having a front surface (106) and an opposing back surface (108) bounded by an upper edge and an opposing lower edge;

(2) a first horizontal portion (94) extending generally perpendicularly from the front surface (106) of the first vertical portion (92) at the lower edge of the first vertical portion (92), the first horizontal portion (94) having a front surface and an opposing back surface bounded by an outer edge and an opposing inner edge wherein the inner edge is coincident with the lower edge of the first vertical portion (92);

(3) a third vertical portion (98) having a front surface (116) and an opposing back surface (118) bounded by an upper edge and an opposing lower edge, wherein the outer edge of the first horizontal portion (94) rests spaced from the upper edge of the third vertical portion (98) adjacent the back surface (118) of the third vertical portion (98), and further wherein the third vertical portion (98) and first vertical portion (92) define a first midband channel (110);

(4) a second horizontal portion (102) extending generally perpendicularly from the back surface (118) of the third vertical portion (98) and terminating at an inner edge, the second horizontal portion having a front surface and an opposing back surface;

(5) a fifth vertical portion (104) extending generally perpendicularly from the front surface of the second horizontal portion (102) at the inner edge of the second horizontal portion (102), thereby forming a second midband channel (124) between the third vertical portion (98) and fifth vertical portion (104), and wherein the fifth vertical portion (104) is generally coplanar with the first vertical portion (92);

whereby the first vertical portion (12) of the base band (10) may be affixed to a lower point on a wall, the fourth vertical portion (62) of the frieze band (50) may be affixed to an upper point on a wall, and the first vertical portion (92) and fifth vertical portion (104) of the midband (90) may be affixed to an intermediate point on the wall so that elongated siding bands mounted horizontally on the wall may be fit into the base band channel, frieze band channel (84), and first and second midband channels (110, 124).

11. The trim band kit of claim 10 further comprising a corner band (126) including six vertically elongated planar portions comprising:

(1) a first portion (128) having a front surface (130) and an opposing back surface (132) bounded by an outer edge and an opposing inner edge;

(2) a second portion (134) extending generally perpendicularly from the front surface (130) of the first portion (128) at the inner edge of the first portion (128), the second portion (134) having a front surface (136) and an opposing back surface (138) bounded by an inner edge and an outer edge coincident with the inner edge of the first portion (128);

(3) a fourth portion (146) having a front surface (148) and an opposing back surface (150) each bounded by an inner edge and an opposing outer edge, thereby defining a first corner band channel (176) between the first portion (128) and fourth portion (146), wherein the inner edge of the second portion (134) rests adjacent the back surface (150) of the third portion (148) adjacent the outer edge of the third portion (150), and further wherein the third portion (150) is generally perpendicular to the second portion (134);

(4) a fifth portion (152) extending from the front surface (148) of the fourth portion (146) at the inner edge of the fourth portion (146), the fifth portion (152) having a front surface (154) and an opposing back surface (156) bounded by an inner edge and an opposing outer edge, wherein the inner edge of the fifth portion (152) is coincident with the inner edge of the fourth portion (146);

(5) a seventh portion (164) having a front surface (166) and a back surface (168) bounded by an outer edge and an opposing inner edge, wherein the inner edge rests adjacent the back surface (156) of the fifth portion (152) spaced from the outer edge of the fifth portion (152), and further wherein the seventh portion (164) is generally perpendicular to the fifth portion (152);

(6) an eighth portion (170) extending generally perpendicularly from the from surface (166) of the seventh portion (164) at the outer edge of the seventh portion (164), thereby defining a second corner band channel (178) between the eighth portion and the fifth portion, whereby the first portion (128) and the eighth portion (170) of the corner band (126) may be respectively affixed to two walls that meet at a generally vertically oriented corner so that the ends of elongated siding bands mounted horizontally on the walls may be fit into the first corner band channel (176) and second corner band channel (178).

12. The trim band kit of claim 11 wherein the corner band (126) further comprises:

(1) a third portion (140) connecting the second and fourth portions (134, 146), the third portion (140) being generally parallel to the fourth portion (146); and (2) a sixth portion (158) connecting the fifth and seventh portions (152, 164), the sixth portion (158) being generally parallel to the fifth portion (152).

13. The trim band kit of claim 10 wherein the lip (22) of the base band (10) includes a fourth vertical portion (22) connecting the first horizontal portion (14) and second vertical portion (16), the fourth vertical portion (22) being generally perpendicular to the first horizontal portion (14).

14. The trim band kit of claim 10 wherein the second vertical portion (16) of the base band (10) is generally parallel to the first vertical portion (12) of the base band (10) and the third vertical portion (20) of the base band (10).

15. The trim band kit of claim 10 wherein the frieze band (50) further comprises a third horizontal portion (64) extending generally perpendicularly from the front surface (70) of the first vertical portion (52) at the upper edge of the first vertical portion (52), thereby forming a soffit channel (74) between the third horizontal portion (64) and the first horizontal portion (54).

16. The trim band kit of claim 10 wherein the frieze band (50) further comprises a third vertical portion (58) connecting the second vertical portion (56) and the second horizontal portion (60), and further wherein the third vertical portion (58) is generally parallel to the second vertical portion (56).

17. The trim band kit of claim 10 wherein the second vertical portion (56) of the frieze band (50) is generally parallel to the first vertical portion (52) and the fourth vertical portion (62) of the frieze band (50).

18. The trim band kit of claim 10 wherein the midband (90) further comprises:

(1) a second vertical portion (96) connecting the first horizontal portion (94) and the third vertical portion (98), the second vertical portion (96) being generally parallel to the third vertical portion (98); and (2) a fourth vertical portion (100) connecting the second horizontal portion (102) and the fifth vertical portion (104), the fourth vertical portion (100) being generally parallel to the third vertical portion (98).

* * * * *